US010889956B2

(12) United States Patent
Du

(10) Patent No.: US 10,889,956 B2
(45) **Date of Patent: *Jan. 12, 2021**

(54) SEA TUNNEL

(71) Applicant: Di Du, Liaoning (CN)

(72) Inventor: Di Du, Liaoning (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/574,957

(22) Filed: Sep. 18, 2019

(65) Prior Publication Data

US 2020/0095746 A1 Mar. 26, 2020

(30) Foreign Application Priority Data

Sep. 20, 2018 (CN) ..... 2018 1 1103779

(51) Int. Cl.
*E02D 29/067* (2006.01)
*E01B 25/00* (2006.01)

(52) U.S. Cl.
CPC ..... *E02D 29/067* (2013.01); *E01B 25/00* (2013.01)

(58) Field of Classification Search
CPC ..... E02D 29/067; E01B 25/00
USPC ..... 405/134, 136
See application file for complete search history.

(56) References Cited

U.S. PATENT DOCUMENTS 3,478,521 A * 11/1969 Petrik ..... B61C 5/00 405/135
3,738,112 A * 6/1973 Grant et al. ..... E02D 29/067 405/136
4,433,937 A * 2/1984 Harrington ..... E02D 29/077 405/132
4,657,435 A * 4/1987 Chang ..... E02D 29/063 405/136
4,767,238 A * 8/1988 Blanc ..... E02D 23/08 14/77.3
5,823,714 A * 10/1998 Chattey ..... E02B 3/06 405/204
5,899,635 A * 5/1999 Kuja et al. ..... E02D 29/067 405/134
6,082,931 A * 7/2000 Hopper ..... E02B 3/06 114/256
6,164,872 A * 12/2000 Morishige ..... E02B 17/00 405/210
7,942,607 B2 * 5/2011 Bauder ..... E21D 9/14 405/136
2007/0248416 A1 * 10/2007 Aristaghes et al. .... E02D 29/07 405/137
2009/0114769 A1 * 5/2009 Campbell ..... B64F 1/00 244/114 R (Continued)

*Primary Examiner* — Tara Mayo-Pinnock
(74) *Attorney, Agent, or Firm* — Bay State IP, LLC

(57) ABSTRACT

The present disclosure provides a sea tunnel, and relates to the technical field of sea-crossing bridge tunnels. The sea tunnel comprises a body; and the body has a hollow cavity extending from one end to the other end, the cavity is divided into mutually independent first cavity and second cavity by a passage pavement, the first cavity is mainly used for passing and is wholly or partly protruded out of the sea level, the second cavity is immersed in the seawater, water holes are formed in the second cavity, and the second cavity is communicated with the seawater through the water holes. When the seawater impacts one side of the body, the second cavity is immersed in the seawater, and the seawater flows into the second cavity, so the body is not easy to be flushed over by the seawater.

8 Claims, 5 Drawing Sheets

(56) References Cited

U.S. PATENT DOCUMENTS

2013/0071189 A1* 3/2013 Aston et al. ..... E01F 5/005
405/126

* cited by examiner

SEA TUNNEL

CROSS REFERENCE TO RELATED APPLICATION

This application claims the benefit of and takes priority from Chinese Patent Application Serial No. 201811103779.4 filed on Sep. 20, 2018 the contents of which are herein incorporated by reference.

TECHNICAL FIELD

The present disclosure relates to the technical field of sea-crossing bridge tunnels, and specifically relates to a sea tunnel.

BACKGROUND OF THE INVENTION

Development of economy facilitates growth of traffic demand and accelerates development of sea-crossing engineering. Currently, a transportation building between two coasts having a large span mainly comprises a sea-crossing bridge and an undersea tunnel.

However, the applicant finds at least the following technical problems in the prior art:

the sea-crossing bridge is very difficult to build generally by deeply striking reinforcing bars into the seabed, then cementing to form bridge piers, finally building a bridge body located on the sea level; the sea has a changeable and severe environment, so it is very difficult to ensure safety and stability of the structure of such bridge between two coasts having a large span; and the undersea tunnel does not prevent ship from sailing on the sea and is not influenced by weather conditions such as strong wind and heavy fog; however, the undersea tunnel is completely built on the seabed, is greatly influenced by diastrophism, seawater pressure, tsunami and the like and has relatively large risks and poor stability and safety; and the existing undersea tunnel is generally built in a neritic region so as to bear a small seawater pressure, but in an abyssal region, the undersea tunnel cannot be built due to influence of seawater pressure, diastrophism and the like. Additionally, the existing undersea tunnel has high costs and is inconvenient to maintain.

SUMMARY OF THE INVENTION

An objective of the present disclosure is to provide a sea tunnel in order to improve a problem that a sea-crossing bridge tunnel is not stable.

The present disclosure is achieved as follows:

a sea tunnel comprises a body, the body has a hollow cavity extending from one end to the other end, the cavity is divided into mutually independent first cavity and second cavity by a passage pavement, the first cavity is partly or wholly protruded out of the sea level, the second cavity is immersed in the seawater, water holes are formed in the second cavity, the second cavity is communicated with the seawater through the water holes, and the bottom end of the body is connected with the seabed through anchor rods.

Furthermore, the second cavity is symmetrically arranged by taking a vertical axis of the body as the axis of symmetry, and two side walls of the second cavity around the axis of symmetry are provided with water holes.

Furthermore, an outer wall of a shell of the body has a bilayer solid structure, and the water holes simultaneously penetrate the bilayer solid structure and communicate the second cavity with the seawater.

Furthermore, the first cavity is formed by an outer wall and an inner wall, which are arranged at intervals, the inner wall has a multilayer structure, a plurality of stabilizing mechanisms in a passage direction of the body are respectively arranged between the outer wall and a layer of the inner wall and between adjacent two layers of the inner wall, each stabilizing mechanism comprises a guide rail arranged in a width direction of the body, a plurality of rollers are arranged in the guide rail, each roller is fixed in the guide rail by utilizing a rotating shaft, the rotating shaft is arranged in the passage direction of the body, and the roller is respectively butted against the outer wall, the layer of the inner wall and the adjacent two layers of the inner wall.

Furthermore, support pillars are arranged in the second cavity, the support pillars are connected with the inner wall and the top end of the second cavity, and the support pillars at least comprise a vertical pillar arranged at the middle portion of the second cavity and inclined pillars arranged on two sides of the vertical pillar.

Furthermore, hydraulic stabilizers are arranged at a connection part of the first cavity and the second cavity, and the hydraulic stabilizers support the bottom of the passage pavement to equalize the pressure of the passage pavement.

Furthermore, bridge brackets are arranged at two ends of the body close to the coast, and the bridge bracket is provided with a spring coil; and the body extends into a transition section of the sea base while the bottom end of the body is fixed to the seabed through combination of the bridge brackets and the anchor rods.

Furthermore, air holes are formed in the first cavity, and the air holes are close to the top end of the first cavity.

Furthermore, the passage pavement is provided with a high-speed railway passage region and a vehicle passage region, and the high-speed railway passage region and the vehicle passage region are arranged at intervals; and an overpass is arranged in the first cavity, the bottom end of the overpass is connected with the passage pavement through first supporting columns, and the top end of the overpass is connected with the top end of the body through second supporting columns.

Furthermore, support bridge piers are arranged at the bottom of the body close to a junction of the body and a ship route, the support bridge piers upraise the second cavity over the sea level so as to vacate the sea surface for passage of ships; or the first cavity is sunk under the sea level to form a totally-enclosed tunnel so as to vacate the sea surface for passage of the ships; and warning buoys are also arranged on two sides in the passage direction of the body, and a distance between the warning buoy and the body is greater than or equal to 5 km.

The beneficial effects of the sea tunnel provided by the present disclosure are:

the sea tunnel comprises the body; the body has a hollow cavity extending from one end to the other end; the cavity is divided into mutually independent first cavity and second cavity by the passage pavement; the first cavity is mainly used for allowing passage; the first cavity is wholly or partly protruded out of the sea level; the second cavity is immersed in the seawater; water holes are formed in the second cavity, and the second cavity is communicated with the seawater through the water holes; the seawater can enter the second cavity to become a part of the second cavity; when the seawater impacts one side of the body, the second cavity is immersed in the seawater, and the seawater flows into the second cavity, so the body is not easy to be flushed over by the seawater; secondly, the bottom end of the body is connected with the seabed through the anchor rods. The second cavity is immersed in the seawater so that the anchor rods resist the buoyancy of the body and the impact force of the seawater to the sidewall of the body. Compared with the traditional bridge, the anchor rods do not provide the anchorage force, so the structure of the whole body is very stable and firm.

Compared with the traditional undersea tunnel, because the first cavity is protruded from the sea level and the second cavity is immersed in the sea, the sea tunnel is less influenced by diastrophism, seawater pressure, tsunami and the like and has higher stability, higher safety and lower costs.

BRIEF DESCRIPTION OF THE DRAWINGS

To describe the technical solutions in the embodiments of the present disclosure or the prior art more clearly, the following briefly introduces the accompanying drawings required for describing the embodiments or the prior art. Apparently, the accompanying drawings in the following description show merely some embodiments in the present disclosure, and a person of ordinary skill in the art may still derive other drawings from these accompanying drawings without creative efforts.

Figure 1:
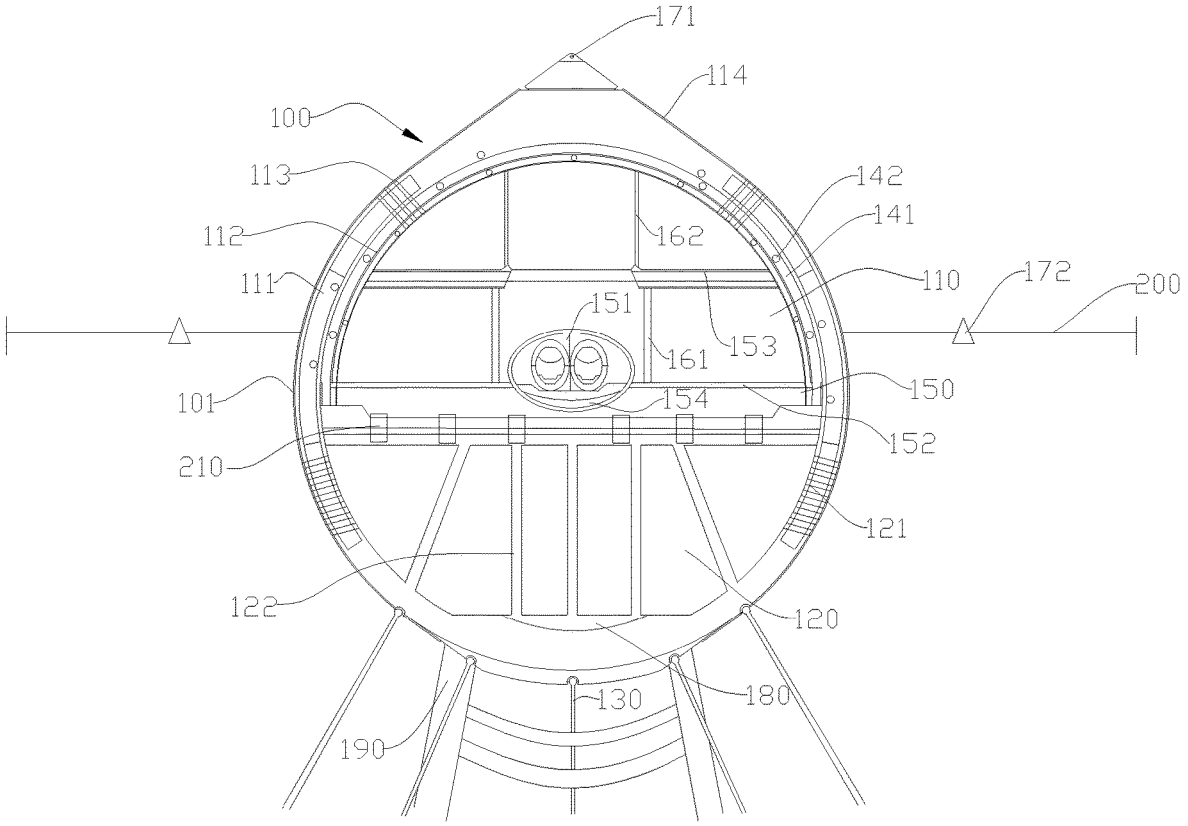
FIG. 1 is a schematic diagram of a sea tunnel provided by an embodiment of the present disclosure in the first view.

In the drawings: 100—sea tunnel, 101—body, 110—first cavity, 111—outer wall, 112—inner wall, 113—air hole, 114—floating solar panel, 115—pipe wall expansion joint, 120—second cavity, 121—water hole, 122—support pillar, 130—anchor rod, 131—annular anchoring part, 141—guide rail, 142—roller, 150—passage pavement, 151—high-speed railway passage region, 152—vehicle passage region, 153—overpass, 154—hydraulic stabilizing layer, 161—first supporting column, 162—second supporting column, 171—lighthouse, 172—warning buoy, 180—weight coating, 190—bridge bracket, 191—spring coil, 200—sea level, 210—pressure stabilizer, 300—ship, 310—support bridge pier, 400—land, 500—ship route, A—land-based section, B—entrance/exit transition section, and C—sea-based section.

DETAILED DESCRIPTION OF THE SEVERAL EMBODIMENTS

To make the objectives, technical solutions, and advantages of the present disclosure clearer, the following describes the technical solutions of the present disclosure in detail. Apparently, the described embodiments are merely a part rather than all of the embodiments of the present disclosure. All other embodiments obtained by a person of ordinary skill in the art based on the embodiments of the present disclosure without creative efforts shall fall within the protection scope of the present disclosure.

In the description of the present disclosure, it should be understood that orientations or position relationships indicated by terms "center", "length", "width", "height", "upper", "lower", "front", "back", "left", "right", "vertical", "horizontal", "top", "bottom", "inside", "outside" and "side", etc. are orientations or position relationships as shown in the accompanying drawings, and these terms are just used to facilitate description of the present disclosure and simplify the description, but not to indicate or imply that the mentioned apparatus or elements must have a specific orientation and must be established and operated in a specific orientation, and thus, these terms cannot be understood as a limitation to the present disclosure. In addition, in the descriptions of the present disclosure, "a plurality of" means two or more unless otherwise indicated.

Embodiment

Figure 2:
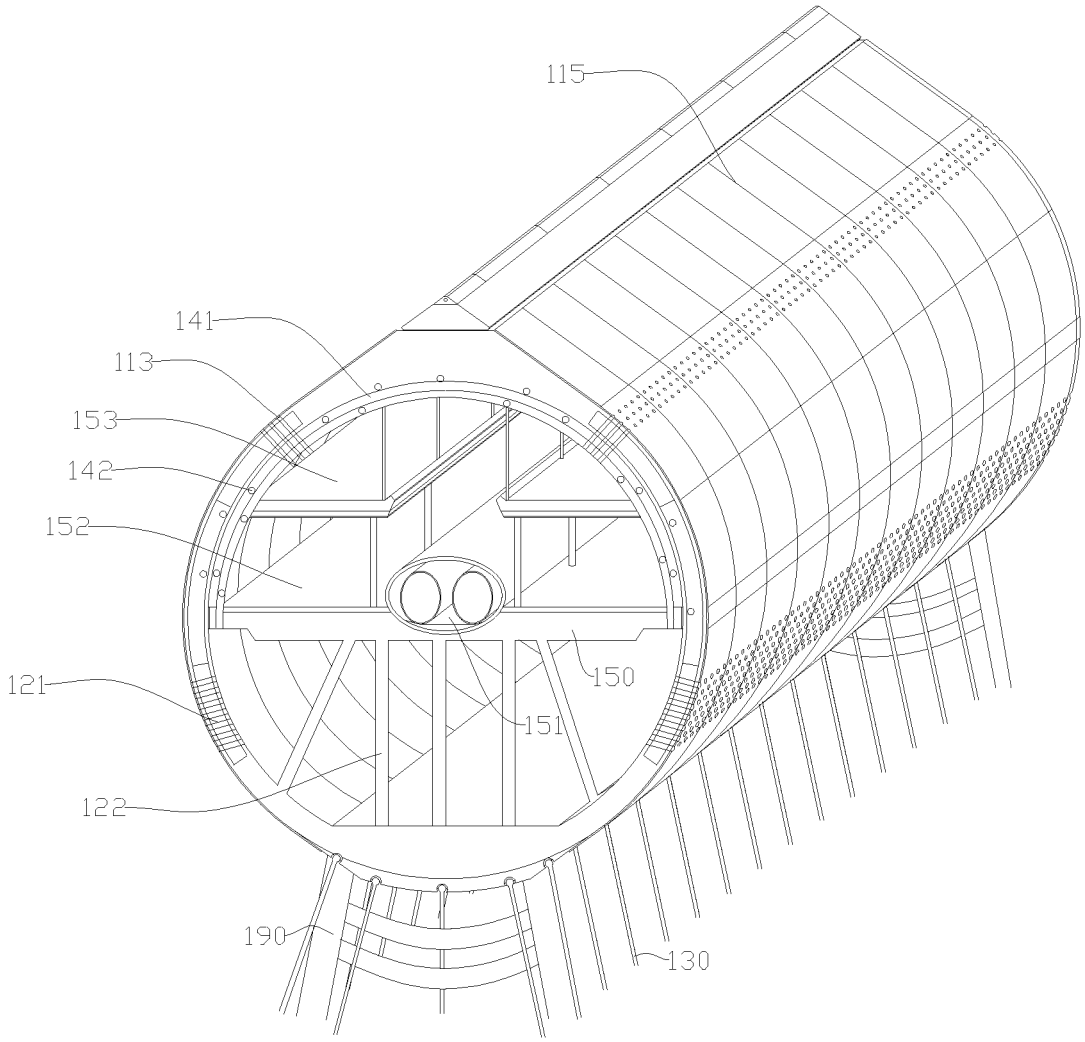
FIG. 2 is a schematic diagram of a sea tunnel provided by an embodiment of the present disclosure in the second view.
Figure 3:
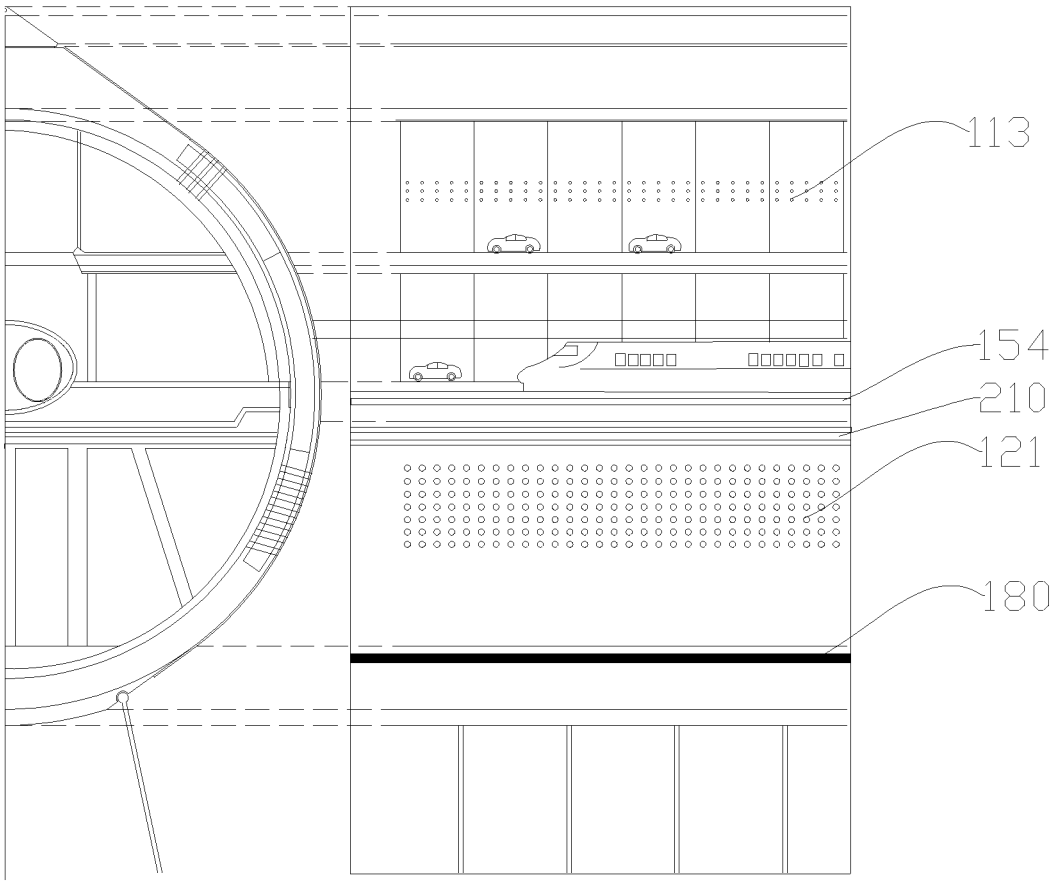
FIG. 3 is a longitudinal sectional view of a sea tunnel.

As shown in FIG. 1, FIG. 2 and FIG. 3, the embodiment provides a sea tunnel 100 which is mainly built between two coasts.

The sea tunnel 100 comprises a body 101. The body 101 has a hollow cavity extending from one end to the other end. The shape of the body 101 is not limited and may be a rectangle, an irregular polygon and the like. Preferably, the body 101 is cylindrical to facilitate production and process and to reduce and resist the impact force of the seawater in the embodiment.

The cavity is divided into mutually independent first cavity 110 and second cavity 120 by a passage pavement 150. In the embodiment, the first cavity 110 is mainly used for allowing passage. The first cavity 110 is wholly or partly protruded out of the sea surface. The second cavity 120 is immersed in the seawater. It should be noted that a part of the body 101 is protruded out of the sea level (namely the first cavity 110) while the other part of the body 101 is immersed under the sea level (namely the second cavity 120).

Water holes 121 are formed in the second cavity 120, and the second cavity 120 is communicated with the seawater through the water holes 121; that is, the seawater can enter the second cavity 120 to become a part of the second cavity 120. When the seawater impacts one side of the body 101, the water holes 121 can reduce the impact force of the seawater to the body 101 to release side to side swaying of the body; and the second cavity 120 is immersed in the seawater, and the seawater flows into the second cavity 120, so the body 101 is not easy to be flushed over by the seawater; secondly, the bottom end of the body 101 is connected with the seabed through anchor rods 130.

In the embodiment, five anchor rods 130 are simultaneously arranged in the width direction of the body 101 to ensure the stability of the body 101, wherein a bottom center anchor rod 130 resists the buoyancy of the body 101 while the four anchor rods 130 on two sides mainly resist the impact force of the seawater to the outer wall of the body so as to release the swaying of the body 101 and ensure the whole structure to be more stable. Certainly, those skilled in the art can further configure other numbers of the anchor rods according to actual situations, but preferably, it should be ensured that the anchor rod is vertically arranged at the center of the bottom and the anchor rods are symmetrically and obliquely arranged on two sides. The second cavity 120 is immersed in the seawater so that the anchor rods 130 only resist the buoyancy of the body 101 and the impact force of the seawater. Compared with the traditional bridge, the anchor rods 130 do not provide the anchorage force for the body 101, so the structure of the whole body 101 is very stable and firm, and requirements on construction and materials are lower.

It should be noted that the a bottom end, connected to the seabed, of the anchor rod 130 in the embodiment is provided with a spring such that the anchor rod 130 can have a certain movement space for resetting. Furthermore, the elastic coefficient of the spring is relatively large, the spring is generally not extended or shrunk randomly, and as long as meeting a relatively large action force, the spring can be extended or shrunk.

Preferably, a weight coating 180 is arranged at the bottom end of the second cavity 120, the weight coating 180 is directly arranged at the bottom end of the second cavity 120 by utilizing some materials having a relatively large density (such as filling some anti-corrosion steel plates, leads and the like), and due to such arrangement, the weight proportion is adjusted by utilizing the weight coating 180, the center of gravity of the whole body 101 moves downwards such that the body 101 is more stable and is not easy to topple over.

Furthermore, the second cavity 120 is symmetrically arranged by taking a vertical axis of the body 101 as the axis of symmetry, two side walls of the second cavity 120 around the axis of symmetry are provided with water holes 121, and at this time, the seawater can simultaneously flow into the second cavity 120 from two sides of the second cavity 120. Preferably, the water holes 121 are arranged at the upper portions of the two side walls of the second cavity 120, and in comparison with arrangement of the water holes 121 at the lower portion of the second cavity 120, such arrangement has the advantage that: the seawater is easier to fill the whole second cavity 120, and when the seawater impacts the second cavity 120, the seawater simultaneously flows into the water holes 121 so as to be capable of reducing the impact force of the seawater to the second cavity, namely releasing the swaying of the seawater. In the embodiment, the number of the water holes 121 is not limited.

In the embodiment, the body 101 is provided with a shell. An outer wall 111 of the shell has a bilayer solid structure, that is, there is no clearance between the two layers of the solid structure. The water holes 121 simultaneously penetrate the bilayer solid structure and communicate the second cavity 120 with the seawater. The shell adopts the bilayer structure so that the safety and the stability of the body 101 can be ensured. When an outer layer structure is broken, an inner layer structure still can be used and keep the balance.

In a preferable embodiment, the first cavity 110 is formed by an outer wall 111 and an inner wall 112 that are arranged at an interval, and it should be noted that the first cavity 110 and the second cavity 120 share the same outer wall 111 having the bilayer structure. The first cavity 110 is a passage space so that the first cavity 110 is further provided with the inner wall 112 in order to improve the safety of the passage space. In the embodiment, as shown in FIG. 1, the inner wall 112 has a multilayer structure; as shown in FIG. 1 and FIG. 2, there are three layers of the inner wall 112, and a three-layer cavity structure is formed among the outer wall 111 and the three layers of the inner wall 112; and in the three-layer cavity structure, namely between the outer wall 111 and an adjacent layer of the inner wall 112 and between the adjacent two layers of the inner walls 112, a plurality of stabilizing mechanisms are arranged in a passage direction of the body 101 (or a length direction of the body 101). The plurality of stabilizing mechanisms are arranged at intervals. The stabilizing mechanism comprises a guide rail 141 arranged in a width direction of the body 101. Specifically, when the passage pavement 150 is arranged at the middle portion (a diameter) of the body 101, the cross section of the guide rail 141 is in shape of a semi-circular arc.

A plurality of rollers 142 are arranged in the guide rail 141, and each roller 142 is fixed to the interior of the guide rail 141 by utilizing a rotating shaft. The rollers 142 can rotate in the guide rail 141 corresponding to the rotating shaft. The rotating shaft is arranged in the passage direction of the body 101. The rollers 142 are respectively arranged between the outer wall 111 and the adjacent layer of the inner wall 112 and between the adjacent two layers of the inner walls 112 in a butting manner. That is, after the inner wall 112 is fixed, and when the water wall 111 rotates under the action of the seawater, the rollers 142 can disperse the rotation action of the outer wall 111 such that the inner wall 112 is not influenced by the outer wall 111 and the stability of the passage space in the whole first cavity 110 is ensured. The three-layer structure of the inner wall 112 is arranged in the outer wall 111 so as to be capable of releasing the action force of the seawater layer by layer and ensuring that the passage pavement at the innermost layer is more stable and is not influenced by the outer layer. Preferably, the plurality of rollers 142 are uniformly arranged in the guide rail 141.

It should be noted that, in the embodiment, the outer wall of the body 101 is made from high resin fiber while the inner wall thereof is made from high-strength steel, so, by simultaneously utilizing the both materials, the corrosion resistance can be achieved, and the strength of the body 101 can be ensured.

Pipe wall expansion joints 115 are also arranged in the passage direction of the body 101; by utilizing the pipe wall expansion joints 115, multiple bodies 101 can be quickly and stably connected; through the pipe wall expansion joints 115, the impact force of the seawater can be buffered to a certain extent, and deformation can be resisted to a certain extent; the streamlined pipe wall expansion joints 115 can reduce the resistance of the sea wind and the sea wave to a certain extent, and the counter-acting force of the sea wave and the sea wind to the body 101 can be correspondingly reduced; and the stability of the body can be improved.

Furthermore, in order to improve the stability of the second cavity 120, namely the body, as shown in FIG. 1, FIG. 2 and FIG. 3, support pillars 122 are arranged in the second cavity 120, the support pillars 122 are connected with the inner wall and the top end of the second cavity 120, and the support pillars 122 at least comprise a vertical pillar arranged at the middle portion of the second cavity and inclined pillars arranged on the two sides of the vertical pillar. In the embodiment, the second cavity 120 is provided with five support pillars 122 in the width direction of the body, wherein three support pillars 122 at the middle portion are arranged vertical to the passage pavement and are mainly used for supporting the passage pavement, and the other two support pillars 122 are symmetrically arranged on two sides of the vertical pillars, are connected with the side wall of the second cavity 120 and the passage pavement 150, and are used for releasing the impact force of the seawater to the second cavity 120 so as to prevent the seawater from causing a relatively large influence on the stability of the body.

The support pillars are arranged in the length direction of the body 101 at a certain distance from each other, and after the seawater flows into the second cavity 120 through the water holes, arrangement of the support pillars 122 can also reduce the impact force of the seawater to the side wall of the second cavity 120 to a certain extent. Preferably, the support pillars 122 can adopt high-strength fiber steel pillars in order to ensure a great strength.

Furthermore, as shown in FIG. 1 to FIG. 3, in order to prevent the stability of the passage pavement form being influenced by the ocean current, hydraulic stabilizers are arranged at a connection part of the first cavity 110 and the second cavity 120, and the hydraulic stabilizers support the bottom of the passage pavement to equalize the pressure of the passage pavement.

The hydraulic stabilizer can select the existing pressure stabilizer 210 to uniformly support the passage pavement, and the pressure stabilizer is used for regulating pressure fluctuation of the pavement instantly caused by loads or the sea waves in order to maintain the balance of the passage pavement. It should be understood that: besides the pressure stabilizer 210, the hydraulic stabilizer can also utilize other existing hydraulic devices, such as a hydraulic pump, wherein the pressure change of the passage pavement is regulated by utilizing the flexibility of the hydraulic device.

Figure 4:
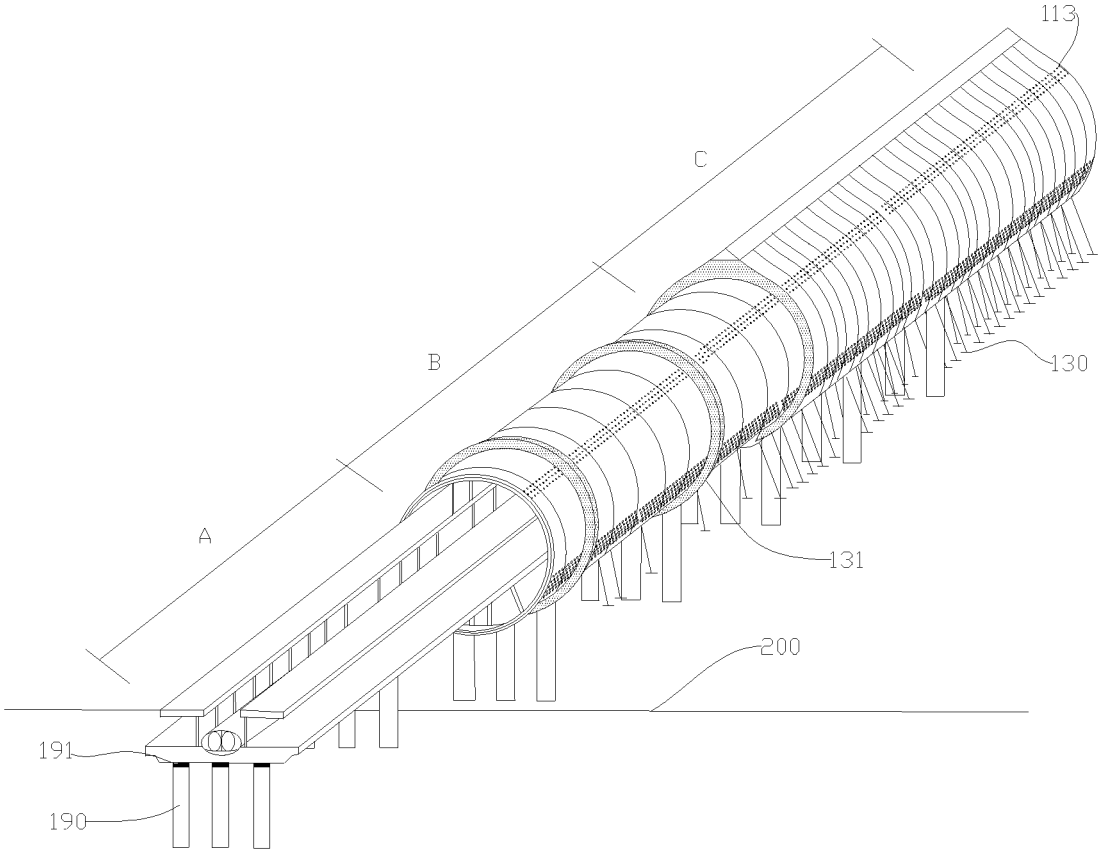
FIG. 4 is a schematic structural diagram of a sea tunnel close to the coast.

Furthermore, bridge brackets 190 are arranged at two ends of the body 101 in the length direction in order to improve the stability of the body 101, and the bridge brackets 190 are made of reinforced concrete. Preferably, as shown in FIG. 4, the body extends to the land from the sea level 200, and a part of the body 101 close to the coast is mainly divided into a land-based section A, an entrance/exit transition section B, and a sea-based section C; at the land-based section A, the body is mainly mounted on the land, so, preferably the bottom of the body is supported by the bridge brackets 190; from the entrance/exit transition section B, the body mainly depends on the support of the reinforced concrete bridge brackets with the help of the fixation of the anchor rods 130; at the sea-based section C, the body is gradually immersed in the sea, but the seawater is insufficient to immerse the second cavity 120, so the bottom of the body still needs support, and a combined fixation manner of the bridge brackets 190 and the anchor rods 130 is utilized; and the body 101 is fixed by the anchor rods 130 till the second cavity 120 is completely immersed in the sea at the enough depth. Referring to FIG. 4, in order to save the costs, a shell structure cannot be arranged at the land-based section A, the entrance/exit transition section B can be provided with a part of an outer wall and an inner wall, and the four-layer structure of the shell is completed arranged at the sea-based section C.

Preferably, a bridge bracket 190 is arranged in the length direction of the body 101 at every 1-1.5 km close to the coast. Furthermore, each bridge bracket 190 is provided with a spring coil 191 to achieve a damping function.

The sectional fixation arrangement manner can be reasonably configured according to a fixation position of the body 101, that is, the support of the bottom is mainly considered close to the land-based section such that a fixation manner mainly utilizes the bridge brackets 190; at a neritic region, a fixation manner of combining the reinforcement concrete bridge brackets 190 with the anchor rods 130 is mainly utilized; and in the deep sea, in order to resist the buoyancy of the seawater and the impact force of the seawater to the shell, a fixation manner of utilizing the vertical and inclined anchor rods 130 is mainly utilized, for example, if the body 101 extends to a part of the sea having the depth of 150 m or more, the body should be fixed by the anchor rods. The above sectional shell arrangement manner can reasonably save the costs according to the actual situations.

Furthermore, air holes 113 are formed in the first cavity 110, and the air holes 113 are close to the top end of the first cavity 110. The air holes 113 can communicate the first cavity 110 with the outside air. Due to the air holes 113, the passage pavement 150 can directly perform air and exhaust air exchange with the outside without a risk of air dilution, and compared with the undersea tunnel, the air exchange is more convenient, and the building costs are also reduced.

Preferably, floating solar panels 114 are also arranged on the outer wall 111 of the first cavity 110, and the floating solar panels 114 are close to the top end of the body 101. The floating solar panels 114 are electrically connected with a power storage component. The floating solar panels 114 can be used for collecting solar energy to provide power for electric parts (such as a lighting system and a ventilation system) in the body 101.

Preferably, a protrusion part is also arranged at the top end of the body 101, a lighthouse 171 is arranged at the protrusion part and can warn approaching ships to prevent the ships from impact the body 101.

In the embodiment, the passage pavement 150 is provided with a high-speed railway passage region 151 and a vehicle passage region 152, and the high-speed railway passage region 151 and the vehicle passage region 152 are arranged at an interval. Preferably, there are two vehicle passage regions 152 respectively located on two sides of the high-speed railway passage region 151. It should be noted that each vehicle passage region 152 may be a one-way road or a multi-way road. Furthermore, the high-speed railway passage region 151 is an unique tunnel. Preferably, in order to accelerate the driving speed of a high-speed railway, the high-speed railway passage region 151 can be closed and vacuumed so as to reduce the air resistance and accelerate by utilizing a vacuum space.

Preferably, the high-speed railway passage region is provided with rails, the high-speed railway can run along the given rail, and a high-speed railway tunnel is in shape of longitudinally extending ellipse in order to reduce the resistance of the high-speed railway in the tunnel and reduce the possibility of rollover. Preferably, a hydraulic stabilization layer 154 is arranged at the bottom of the high-speed railway passage region 151, the hydraulic stabilization layer 154 can utilize the existing pressure stabilizer or other pressure stabilizers such as a hydraulic pump and the like, and the hydraulic stabilization layer 154 is used for regulating pressure fluctuation of the high-speed railway passage region instantly caused by loads or the sea waves in order to maintain the balance of the high-speed railway passage region.

An overpass 153 is arranged in the first cavity 110, the bottom end of the overpass 153 is connected with the passage pavement 150 through first supporting columns 161, and the top end of the overpass 153 is connected with the top end of the body 101 through second supporting columns 162. Preferably, there are two overpasses 153, and the overpasses 153 are corresponding to the vehicle passage regions 152 one to one. Additionally, each overpass 153 may be a one-way road or a multi-way road.

Figure 5:
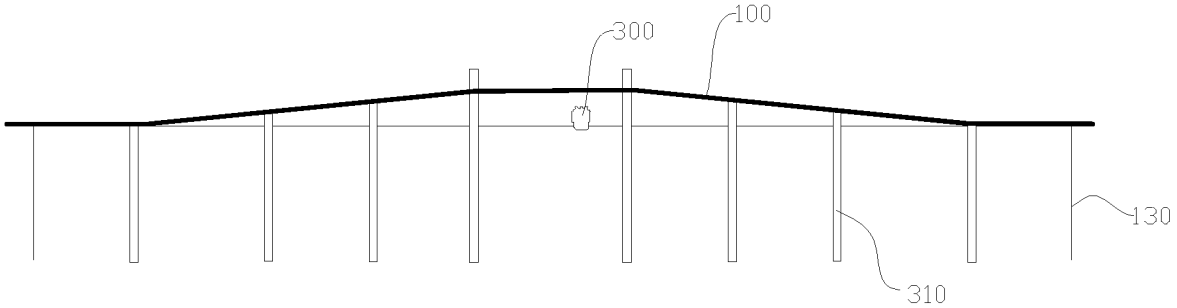
FIG. 5 is a schematic diagram of a first embodiment of a junction of a sea tunnel provided by an embodiment of the present disclosure and a ship route.
Figure 6:
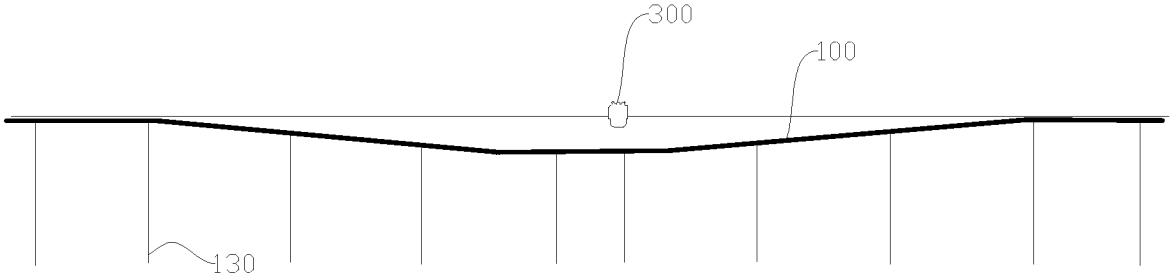
FIG. 6 is a schematic diagram of a second embodiment of a junction of a sea tunnel provided by an embodiment of the present disclosure and a ship route.
Figure 7:
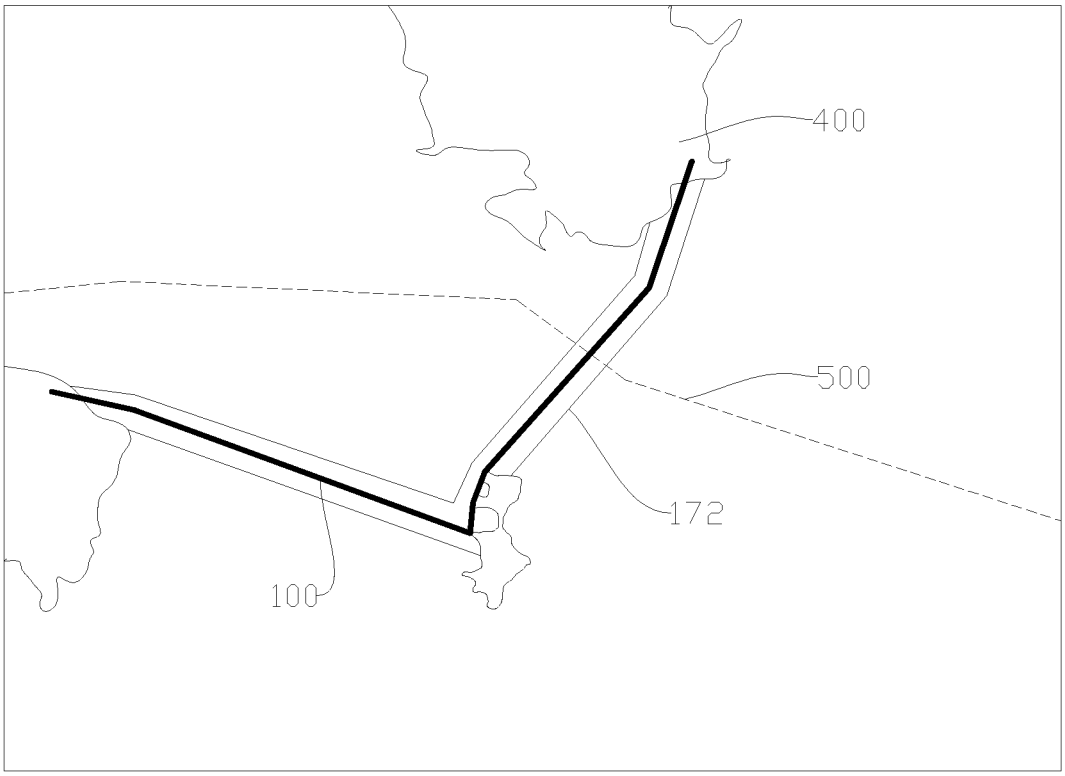
FIG. 7 is an aerial view shows connection of a sea tunnel and coasts and a junction of the sea tunnel and a ship route.

Furthermore, referring to FIG. 7, FIG. 7 is an aerial view shows connection of a sea tunnel and coasts and a junction of the sea tunnel and a ship route; and according to the junction of the sea tunnel 100 and the given ship route 500, in order to not influence the regular sailing of the ship, the embodiment mainly adopts the following two solutions:

firstly, referring to FIG. 5 and FIG. 7, FIG. 5 is a schematic diagram of a first embodiment of a junction of a sea tunnel provided by an embodiment of the present disclosure and a ship route; the support bridge piers 310 are arranged at the bottom of the sea tunnel close to the junction of the sea tunnel and the ship route 500, the support bridge piers 310 upraise the second cavity 120 over the sea level so as to vacate the sea surface for passage of ships; the above support bridge pier 310 can be made from high-strength materials such as high-strength fiber steel vertical columns and the like; it should be understood that the sea tunnel should be gradually upraised from a certain distance close the junction of the sea tunnel and the ship route, that is, a part from the junction of the sea tunnel and the ship route to an upraised part should have a certain gradient, the smaller the gradient is, the more stable the structure is, and the gradient should be set specifically according to the actual situation and the costs; and at the junction, an enough height should be provided from the bottom end of the body 101 to the sea surface in order to allow the passage of the ships, cruise ships and the like; multiple support bridge piers can be arranged in an extension direction of the sea tunnel, and its number is not limited.

secondly, referring to FIG. 6 and FIG. 7, FIG. 6 is a schematic diagram of a second embodiment of a junction of a sea tunnel provided by an embodiment of the present disclosure and a ship route; the first cavity 110 is sunk under the sea level to form a totally-enclosed tunnel close to the a junction of the body and the ship route 500 so as to vacate the sea surface for passage of the ship; similarly, the sea tunnel should be gradually reduced from a certain distance at the junction of the sea tunnel and the ship route, that is, a part from the junction of the sea tunnel and the ship route to a reduced part should have a certain gradient, and at the junction of the sea tunnel and the ship route, an enough height should be provided from the top end of the body 101 to the sea surface in order to allow the passage of the ships, cruise ships and the like; at this time, the bottom of the body 101 can be fixed by the anchor rods 130.

Referring to FIG. 7, the sea tunnel 100 crosses the sea to connect the lands 400 of two coasts such that a land-closed island can be connected to be a transfer station. In order to prevent other ships from colliding the body, furthermore, warning buoys 172 are also arranged on two sides in the passage direction of the body 101, and a distance between the warning buoy 172 and the body 101 is greater than or equal to 5 km. It should be noted that a warning buoy 172 can be arranged at every 20-50 m in the passage direction of the body 101, and multiple warning buoys 172 can be connected to form a warning line in order to warn ships close to the body. Besides, a radar warning and audible-visual electric-wave automatic warning system can also be utilized to prevent a ship or an underwater submarine from approaching, and can prevent other ships or submarines from colliding the body, so the safety is better.

In conclusion, the sea tunnel provided by the embodiment at least has the following advantages:

1, a sea-cross tunnel having a new structure is utilized: the first cavity of the body is protruded out of the sea level, and the passage level is close to the sea surface so as to be capable of directly perform air exchange without a risk of air dilution; the second cavity is immersed under the sea level, and the bottom end of the body is connected with the seabed through the anchor rods such that the sea tunnel is more stable, is not easy to be influenced by the sea environment, diastrophism, seawater pressure and the like, and can also keep great stability under earthquake, tsunami and the like;

furthermore, wind and the sea water can communicated with the body, the water holes can reduce the impact of the seawater to the outer wall of the body so as to reduce the influence of seawater pressure, and the stability of the body is better;

2, the shell of the body has the bilayer structure so as to be very firm;

3, the three-layer inner wall structure is arranged in the outer wall, the stabilizing mechanism is respectively arranged between the outer wall and the adjacent layer of the inner wall and the adjacent two layers of the inner wall, the stabilizing mechanism is provided with the rollers, and by utilizing the rollers, the action force of the outside, such as the seawater, the sea wind, the earthquake and the like, can be released layer by layer, the passage pavement at the innermost layer is ensured to be more stable, and the inner wall of the first cavity is not influenced by the outer layer, thereby ensuring the stability of the passage space;

4, the first cavity is internally provided with the high-way railway passage region and the vehicle passage region so as to be capable of meeting various traffic manners and to be more convenient;

5, the body support bridge piers upraise the second cavity over the sea level or enable the first cavity to be sunk under the sea level to form a totally-enclosed tunnel close to the junction of the body and a ship route so as to vacate the sea surface for passage of the ships; therefore, the sea tunnel does not influence the sailing of the ship on a given route; the warning buoys are arranged on two sides of the body, and a radar warning and audible-visual electric-wave automatic warning system is utilized to prevent the ship from approaching and can prevent other ships from colliding the body, so the safety is better; and 6, the whole structure of the sea tunnel can effectively save the costs for building the tunnel, and according to the geologic structure, the tunnel can be supported by arranging reinforcement concrete columns at a seawater depth of 150 m or can utilize a combined fixation manner of the cement columns and the anchor rods.

The specific features, structures or characteristics described in the specification may be combined in any suitable manner in one or more embodiments or examples.

The above merely describes specific embodiments of the present disclosure, but the protection scope of the present disclosure is not limited thereto. A person skilled in the art can easily conceive modifications or replacements within the technical scope of the present disclosure, and these modifications or replacements shall fall within the protection scope of the present disclosure. Therefore, the protection scope of the present disclosure should be subject to the protection scope of the claims.

What is claimed is:

1. A sea tunnel, comprising a body, wherein the body has a hollow cavity extending from one end to the other end, the cavity is divided into mutually independent first cavity and second cavity by a passage pavement, the first cavity is wholly or partly protruded out of a sea surface, the second cavity is immersed in the seawater, water holes are formed in the second cavity, the second cavity is communicated with the seawater through the water holes, and the bottom end of the body is connected with the seabed through anchor rods; and wherein an outer wall of a shell of the body has a bilayer solid structure, and the water holes simultaneously penetrate the bilayer solid structure and communicate the second cavity with the seawater.

2. The sea tunnel according to claim 1, wherein the second cavity is symmetrically arranged by taking a vertical axis of the body as the axis of symmetry, and two side walls of the second cavity around the axis of symmetry are provided with water holes.

3. The sea tunnel according to claim 1, wherein the first cavity is formed by an outer wall and an inner wall, which are arranged at intervals, the inner wall has a multilayer structure, a plurality of stabilizing mechanisms in a passage direction of the body are respectively arranged between the outer wall and a layer of the inner wall and between adjacent two layers of the inner wall, each stabilizing mechanism comprises a guide rail arranged in a width direction of the body, a plurality of rollers are arranged in the guide rail, each roller is fixed in the guide rail by utilizing a rotating shaft, the rotating shaft is arranged in the passage direction of the body, and the roller is respectively butted against the outer wall, the layer of the inner wall and the adjacent two layers of the inner wall.

4. The sea tunnel according to claim 1, wherein support pillars are arranged in the second cavity, the support pillars are connected with the inner wall and the top end of the second cavity, and the support pillars at least comprise a vertical pillar arranged at the middle portion of the second cavity and inclined pillars arranged on two sides of the vertical pillar.

5. The sea tunnel according to claim 1, wherein hydraulic stabilizers are arranged at a connection part of the first cavity and the second cavity, and the hydraulic stabilizers support the bottom of the passage pavement to equalize the pressure of the passage pavement.

6. The sea tunnel according to claim 1, wherein bridge brackets are arranged at two ends of the body close to a coast, and the bridge bracket is provided with a spring coil; and the body extends into a transition section of a sea base while the bottom end of the body is fixed to the seabed through combination of the bridge brackets and the anchor rods.

7. The sea tunnel according to claim 1, wherein air holes are formed in the first cavity, and the air holes are close to the top end of the first cavity.

8. The sea tunnel according to claim 1, wherein the passage pavement is provided with a high-speed railway passage region and a vehicle passage region, and the high-speed railway passage region and the vehicle passage region are arranged at intervals; and an overpass is arranged in the first cavity, the bottom end of the overpass is connected with the passage pavement through first supporting columns, and the top end of the overpass is connected with the top end of the body through second supporting columns.

* * * * *